United States Patent [19]

Blaser

[11] 4,386,598

[45] Jun. 7, 1983

[54] SLING SHOT APPARATUS

[76] Inventor: Anton J. Blaser, 700 E. Mason, Santa Barbara, Calif. 93103

[21] Appl. No.: 280,079

[22] Filed: Jul. 2, 1981

[51] Int. Cl.[3] ..... F41B 7/00

[52] U.S. Cl. ..... 124/21; 124/83; 124/41 B

[58] Field of Search ..... 124/17, 21, 22, 26, 124/27, 41 R, 41 B, 83, 20 R, 20 B

[56] References Cited

U.S. PATENT DOCUMENTS

| | | | |
|---|---|---|---|
| 3,515,113 | 6/1970 | Lawrence | 124/25 X |
| 3,913,554 | 10/1975 | Pitcher | 124/41 B X |
| 3,949,729 | 4/1976 | Pfotenhauer | 124/20 B |

FOREIGN PATENT DOCUMENTS

| | | | |
|---|---|---|---|
| 653458 | 5/1951 | United Kingdom | 124/20 R |

*Primary Examiner*—Richard C. Pinkham
*Assistant Examiner*—William R. Browne
*Attorney, Agent, or Firm*—Ralph B. Pastoriza

[57] ABSTRACT

The sling-shot apparatus includes a handle with lateral arms to which an elastic cord is attached to form a sling. A projectile holding member is connected to this sling and also, a guide structure provided for guiding the movement of the projectile holding member along a rectilinear path when the elastic cord is stretched and released. Sighting members can be provided on the guide structure so that much greater accuracy is possible with the sling-shot.

6 Claims, 4 Drawing Figures

SLING SHOT APPARATUS

This invention relates to sling-shots and more particularly to an improved sling-shot apparatus for improving greatly the accuracy with which projectiles can be propelled by the sling-shot.

BACKGROUND OF THE INVENTION

Conventional sling-shots comprise a handle member with upwardly and outwardly extending arms defining a "yoke". An elastic cord or band defines a sling with the ends connected to the far ends of the arms. A projectile is cradled in the sling and the user will hold the handle with one hand and pull back the sling with the other.

It can be appreciated from the foregoing description that unless the two elastic portions of the sling are tensioned equally, the projectile will tend to veer off to one side or the other when the same is released. Also, there is no easy means of consistently positioning the vertical level of the sling and projectile when retracted relative to the ends of the arms to which the elastic sling is connected so that control as to the "altitude" of the projectile when released is difficult.

BRIEF DESCRIPTION OF THE PRESENT INVENTION

With the foregoing considerations in mind, the present invention contemplates an improved sling-shot structure in which the above-noted problems are overcome all to the end that a sling-shot apparatus of greater accuracy results.

More particularly, in accord with the present invention there is provided a handle with left and right arms extending laterally from opposite upper side portions on the handle. The elastic cord means extend from the far ends of the arms in a rearward direction to define a sling. A specially designed projectile holding means is secured in the sling and cooperates with a rectilinear guide means secured to the handle. The arrangement is such that the projectile holding means is guided by the guide means to follow a rectilinear path when the sling is pulled back and released. As a consequence, the projectile itself is released along a rectilinear path which is fixed relative to the handle and lateral arms for the elastic cord sling so that equal arm tension is always assured and accurate firing is possible.

In addition, the preferred embodiment utilizes front and rear sights to enable a person to further increase the accuracy with which a projectile can be shot by the sling-shot.

BRIEF DESCRIPTION OF THE DRAWINGS

A better understanding of this invention will be had by now referring to the accompanying drawings in which.

DETAILED DESCRIPTION OF THE INVENTION

Figure 1:
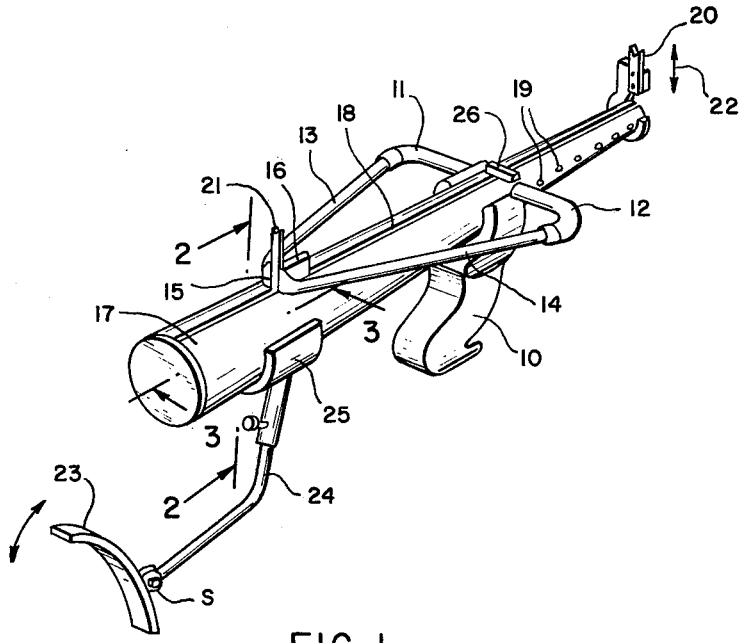
FIG. 1 is a prospective view of my preferred embodiment of a sling-shot apparatus.

Referring first to FIG. 1, the apparatus includes a handle 10, from which left and right arms 11 and 12 laterally extend from opposite portions. Elastic cord means in the form of first and second elastic cords 13 and 14 extend from the far ends of the arms in a rearward direction to define a sling or cradle portion 15.

A projectile holding means 16 is cradled in the sling 15.

In the preferred embodiment of FIG. 1, there is provided a rectilinear guide means 17 in the form of a C-shaped rail in cross-section defining an elongated slot 18 parallel to the axis of the rail for receiving the projectile holding means 16 and guiding movement thereof along a rectilinear path.

The handle 10 itself, is secured to the underside of the rail 17, and by providing appropriate openings such as indicated at 19 spaced longitudinally along the rail, the position of the handle 10 can be changed or shifted along the rail by securing the arms 11 and 12 in different opposite openings such as the openings 19.

Also illustrated in FIG. 1 is a front sight and a rear sight 21 secured to the projectile holding means 16. Front sight 20 may be adjustable in heighth as indicated by the double-headed arrow 22, so as to enable proper alignment with the rear sight 21.

To further increase accuracy and enable the sling-shot apparatus to be held in a steady position when firing, the structure of FIG. 1 includes a shoulder support 23 coupled to the rail 17 as by arm 24 and saddle structure 25. The position of the shoulder support 23 relative to the rail 17 can be adjusted both horizontally and vertically as well as swivelled about arm 24 as indicated at S.

Finally, there is shown in FIG. 1 a stop member 26 which bridges the slot 18 and the rail 17. This stop member will check the forward motion of the projectile holding means 16 when the elastic cords 13 and 14 are stretched rearwardly by the user and the sling 15 is released. The forward momentum imparted to a projectile will cause the projectile to continue along the rectilinear path defined by the rail 17.

Figure 2:
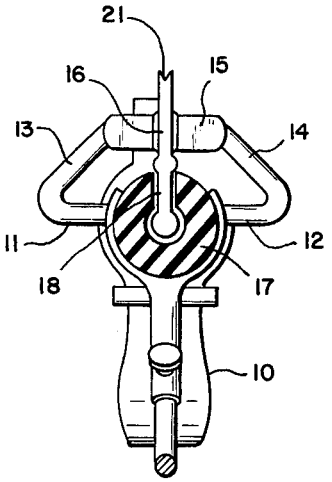
FIG. 2 is a cross-section taken in the direction of the arrows 2—2 of FIG. 1.
Figure 3:
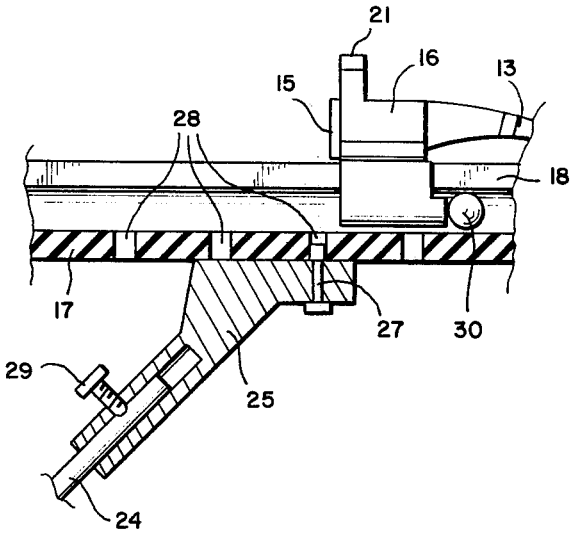
FIG. 3 is a fragmentary cross-section taken in the direction of the arrows 3—3 of FIG. 1.

The foregoing operation will become clearer by now referring to FIGS. 2 and 3.

Referring first to FIG. 2, the C-shaped cross-section of the rail 17 will be evident. Moreover, it will be noted that the projectile holding means 16 extends radially to the central portion of the rail which defines a smoothe bore.

In FIG. 3, the connection of the saddle portion 25 to the underside of the rail 17 is effected by means of a single bolt or screw 27 which can be received in any one of a plurality of openings 28 spaced longitudinally along the underside of the rail. Depending upon the particular opening selected, the longitudinal position of the shoulder support 23 described in FIG. 1 will be determined. This longitudinal position as well as the vertical level of the shoulder support 23 can be further adjusted by means of the telescoping connection of the arm 24 within the saddle structure 25 as clearly shown in FIG. 3. An appropriate set screw lock 29 is provided to secure the telescopic portions in a fixed position after appropriate adjustments have been made.

In the cross-section of FIG. 3 there is also shown a projectile in the form of a spherical metal ball 30. The projectile holding means 16 itself includes a magnet and the projectile 30 is made of magnetic responsive material so as to be held by the holder when firing.

From all of the foregoing, it will now be appreciated that a projectile can be very accurately fired by means of the sling shot described.

More particularly, and with reference once again to FIG. 1, a projectile such as the projectile 30 is initially dropped into the front end of the bore of the rail 17 so that it will roll back and engage magnetically the projectile holding means 16. This holding means cradled within the sling 15 is then withdrawn rearwardly along the slot 18 while a user holds the handle 10 with his left hand and retracts the sling with his right hand. The shoulder support 23 in this position would be cradled against the user's right shoulder.

The user can aim at a target by means of the rear sight and forward sight 21 and 20 and when he releases the projectile holding means 16, the entire holding means along with the sling will propel forwardly via the slot 18 the projectile 30 within the bore of the rail 17.

When the projectile holding means 16 engages the stop 26, the projectile 30 will continue forwardly out the front bore as described heretofor because of its momentum.

Figure 4:
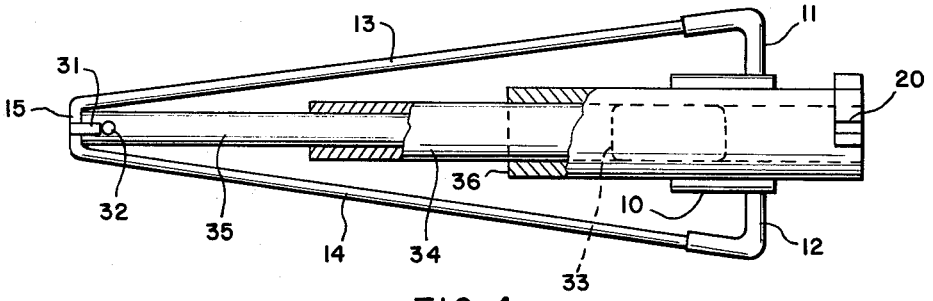
FIG. 4 is a top plan view of a second embodiment of my invention.

Referring now to the top plan view of FIG. 4, there is shown a second embodiment of the invention wherein the same handle 10, lateral arms 11 and 12, elastic cords 13 and 14, and sling 15 can be used. However, in the embodiment of FIG. 4, the projectile holding means is indicated at 31 and supports a projectile 32 exterior of and at a level higher than the rectilinear support means to which the handle 10 is secured. In this respect, the embodiment of FIG. 4 utilizes rectilinear guide means in the form of a plurality of coaxial telescoping tubes 33, 34 and 35. The handle 10 is secured to the underside of the larger tube 33 and this tube may also carry a forward sight similar to the sight 20 shown in FIG. 1 and designated by the same numeral in FIG. 4.

The rear angular entrance periphery of the tube 33 receiving the telescoping tube 34 serves as a stop to check movement of the projectile holding means 31 when firing the sling shot. Thus, in operation a user will simply hold the handle 10 with one hand and then withdraw the sling and projectile holding means 31 with the other, a projectile 32 being magnetically held to the holding means 31. The tubes will telescope outwardly into a longer configuration and because of their coaxial relationship, they will guide movement both rearwardly and forwardly of the projectile holding means in a rectilinear path. When the user now releases the sling 15, the tubes will collapse telescopically and when the projectile holding means 31 strikes the peripheral edge 36 of the larger tube 33, the momentum of the prjectile 32 will cause it to continue forwardly passing beneath the sight 20 close to top surface of the outer tube 33.

The advantage of the embodiment of FIG. 4 is that the entire structure can be collapsed into a compact configuration when not in use. However, it is not as accurate as the apparatus of the first embodiment described in FIGS. 1, 2 and 3.

I claim:

1. A sling shot apparatus including, in combination:

(a) a handle;

(b) left and right arms extending laterally from opposite upper side portions of said handle;

(c) elastic cord means extending from the far ends of said arms in a rearward direction to define a sling;

(d) projectile holding means connected to said sling;

(e) rectilinear guide means secured to said handle and cooperating with said projectile holding means to guide said projectile holding means for movement along a rectilinear path, the forward end of said rectilinear guide means including a front sighting member for use with said projectile holding means;

(f) a shoulder support secured to a rear underside portion of said rectilinear guide means; and (g) means for adjusting the position of the shoulder support horizontally and vertically relative to said rectilinear guide means whereby said projectile holding means can be pulled rearwardly with one end while holding said handle with the other hand, and then released, said guide means assuring that a projectile held by said projectile holding means will be propelled along said given rectilinear path.

2. An apparatus according to claim 1, in which said front sighting member is adjustable in height.

3. An apparatus according to claim 1, in which said rectilinear guide means comprises an elongated C-shaped rail in cross-section defining an elongated slot parallel to said given rectilinear path, said projectile holding means riding in said slot, said handle being secured to the underside of said rail.

4. An apparatus according to claim 3, including means for enabling the longitudinal position of said handle on the underside of said rail to be adjusted.

5. An apparatus according to claim 1, in which said rectilinear guide means comprises a plurality of coaxial telescoping tubes parallel to said given rectilinear path, said handle being secured to the underside of the outer one of said tubes.

6. An apparatus according to claim 1, in which said projectile holding means incorporates a magnet for holding projectiles of magnetic material.

* * * * *